US006032739A

United States Patent [19]

Newman

[11] Patent Number: 6,032,739

[45] Date of Patent: Mar. 7, 2000

[54] METHOD OF LOCATING WELLBORE CASING COLLARS USING DUAL-PURPOSE MAGNET

[76] Inventor: Frederic M. Newman, 1618 W. Dengar, Midland, Tex. 79705

[21] Appl. No.: 09/134,880

[22] Filed: Aug. 15, 1998

[51] Int. Cl.[7] ..... E21B 29/02; E21B 47/09; E21B 43/119

[52] U.S. Cl. ..... 166/297; 166/66.5; 166/255.2; 166/66; 175/4.51; 175/4.52

[58] Field of Search ..... 166/66.5, 66, 255.1, 166/255.2, 297; 175/4.51, 4.52

[56] References Cited

U.S. PATENT DOCUMENTS 3,110,257 11/1963 Lebourg ..... 175/4.52
3,165,153 1/1965 Lanmon ..... 175/4.51
3,182,724 5/1965 Shore ..... 175/4.52
4,153,118 5/1979 Hart ..... 175/4.51
5,720,344 2/1998 Newman .

*Primary Examiner*—David Bagnell
*Assistant Examiner*—Elaine Gort
*Attorney, Agent, or Firm*—Robert J. Harter

[57] ABSTRACT

A method for sensing the location of a casing collar within a wellbore and for orientating a tool circumferentially and radially employs the use of a compact dual-purpose magnet. The method includes offsetting the position of the magnet relative to the tool's centerline to carry out the magnet's purpose of orientating the tool. An inductive pickup coil is placed within the magnet's magnetic field to carry out the magnet's second purpose of sensing the location of a casing collar. The method is used in logging the location of casing collars, splitting casing collars, and perforating casings.

8 Claims, 3 Drawing Sheets

METHOD OF LOCATING WELLBORE CASING COLLARS USING DUAL-PURPOSE MAGNET

BACKGROUND OF THE INVENTION

1. Field of the Invention

The subject invention generally pertains to a method of locating casing collars of a wellbore, and more specifically to a method of using the same magnet for both sensing collars and positioning a tool.

2. Description of Related Art

Tools for perforating or dismantling wellbore casings often include a magnet for sensing the presence of a casing collar. Some of the more compact tools also include a second magnet for properly orientating (both radially and circumferentially) the tool within the casing. This second magnet, however, adds bulk to the tool. This is a great disadvantage, as these tools often need to slip through narrow constructions deep within a wellbore. In addition, two magnets are obviously more expensive than one.

SUMMARY OF THE INVENTION

To overcome the limitations of current methods of sensing casing collars, perforating casings, and splitting casing collars; it is an object of the invention to minimize the number of components used in sensing the location of casing collars.

Another object of the invention is to employ a single magnet for both sensing the location of a casing collar and for orientating a tool circumferentially and radially (standoff).

Another object is to minimize the size of a tool needed in servicing a wellbore.

These and other objects of the invention are provided by a novel method of employing a single magnet for both sensing the location of a casing collar and for orientating a tool circumferentially and radially. The method includes offsetting the position of the magnet relative to the tool's centerline and placing an inductive pickup coil within the magnet's magnetic field.

DESCRIPTION OF THE PREFERRED EMBODIMENT

Figure 1:
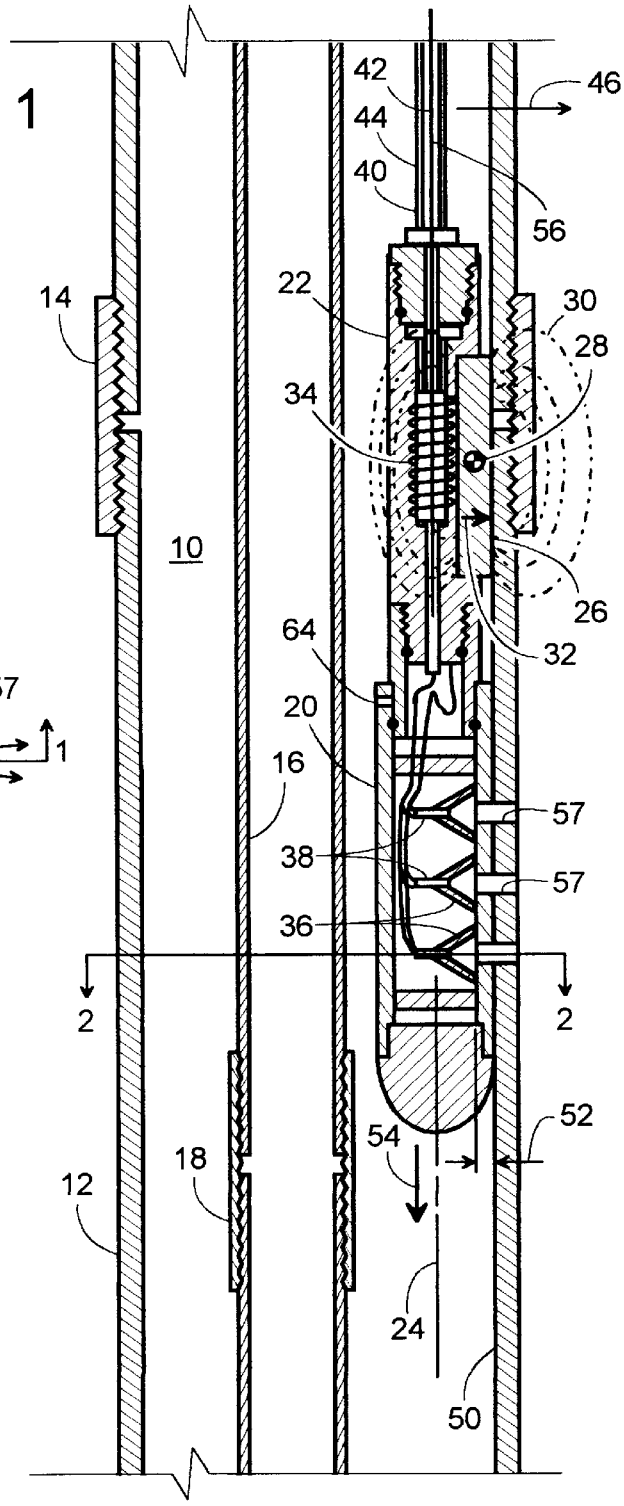
FIG. 1 is a cross-sectional view of the invention taken along line 1—1 of FIG. 2.
Figure 2:
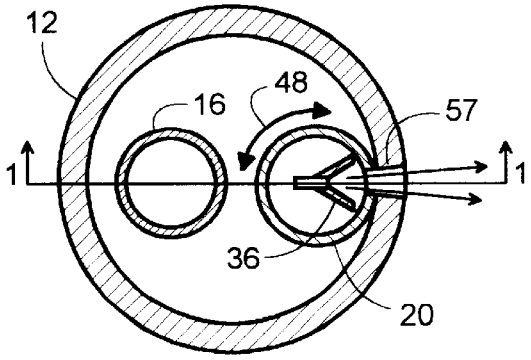
FIG. 2 is a cross-sectional view of the invention taken along line 2—2 of FIG. 1.

A wellbore 10 is shown to include a string of casing pipes 12 interconnected by casing collars 14. An inner string of tubing 16 interconnected by pipe couplings 18 runs through the interior of casing pipes 12.

A perforation tool 20 is situated between casing pipes 12 and tubing 16. Perforation tool 20 includes a housing 22 having a longitudinal centerline 24, a dual-purpose magnet 26 having a center of gravity 28 and a magnetic field 30 that exerts a magnetic force 32, an electrical coil 34 exposed to magnetic field 30, and several explosive charges 36 each being denoted by an electrically ignitable cap 38. Tool 20 is suspended by a coaxial cable 40 having an inner conductor 42 and an outer conductor 44 (grounded outer armor). Inner conductor 42, coil 34, housing 22, and outer conductor 44 are electrically connected in series. Cap 38 and coil 34 are connected in parallel with a reflective dual-diode that has a significantly high threshold voltage to prohibit the induced voltage in coil 34 from reaching cap 38.

The center of gravity 28 of magnet 26 is radially offset from centerline 24 in a forward direction 46. The primary discharge of explosive charges 36 also generally faces forward direction 46. In this arrangement, magnet 26 circumferentially orientates the discharge faces of explosives 36 and draws them up against the inner wall 50 of casing 12. Providing a proper circumferential position 48 and establishing a proper radial distance 52 (standoff) of explosives 36 is the first purpose of dual-purpose magnet 26.

The second purpose of magnet 26 is to identify the location of a casing collar 14. As magnet 26 is lowered (depicted by arrow 54) past casing collar 14, magnetic field 30 is disturbed. This disturbance induces an electrical current in coil 34, thereby generating an electrical signal 56. Coaxial cable 40 conveys signal 56 to an operator that monitors signal 56 and compares it to the depth that housing 22 has been lowered. This allows the operator to identify the location of casing collar 14.

Once a casing collar 14 is located, the operator can position charges 36 to perforate casing 12 at a location somewhere other than exactly at casing collar 14. Each of charges 36 are generally round for producing several round holes 57 through which a fluid (e.g., oil, water) can be drawn into casing 12.

Figure 3:
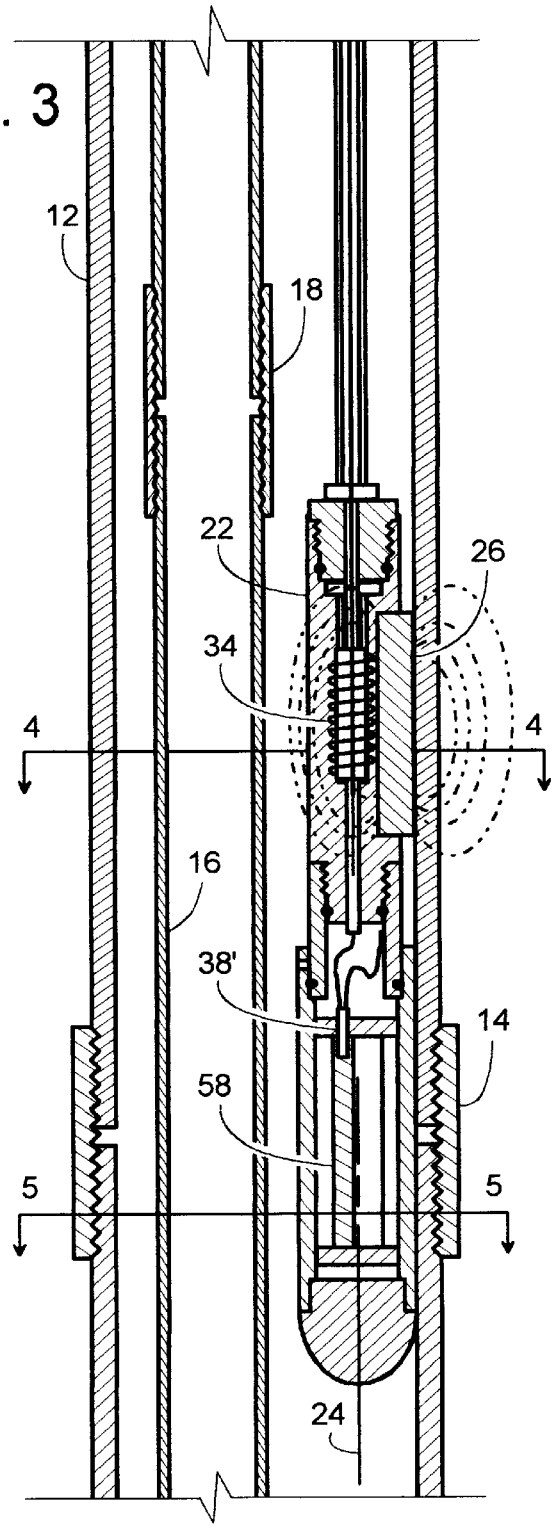
FIG. 3 is a cross-sectional view of a second embodiment of the invention taken along line 3—3 of FIG. 4.
Figure 4:
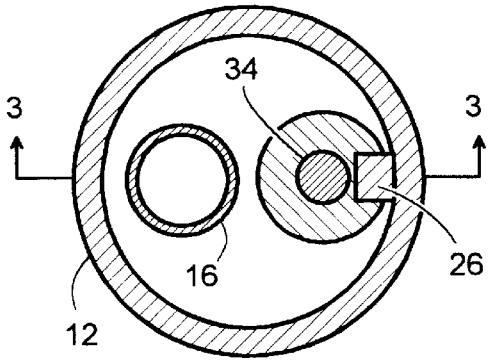
FIG. 4 is a cross-sectional view of the second embodiment of the invention taken along line 4—4 of FIG. 3.
Figure 5:
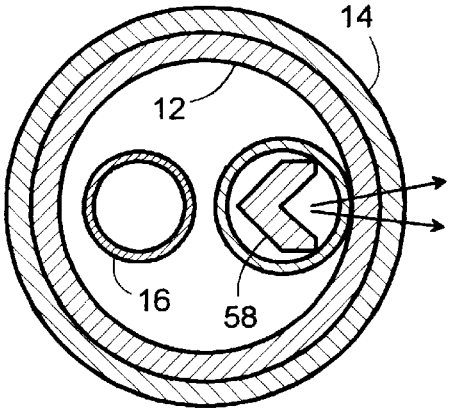
FIG. 5 is a cross-sectional view of the second embodiment of the invention taken along line 5—5 of FIG. 3.

FIGS. 3, 4 and 5 illustrate another embodiment of the invention that is similar to the one just discussed, except round charges 36 are replaced by a linear charge 58 that is detonated by an electrically ignitable cap 38'. Unlike round charges 36, linear charge 58 is aimed directly at casing collar 14. Charge 58 splits collar 14 lengthwise to facilitate the dismantling of casing pipes 12.

Figure 6:
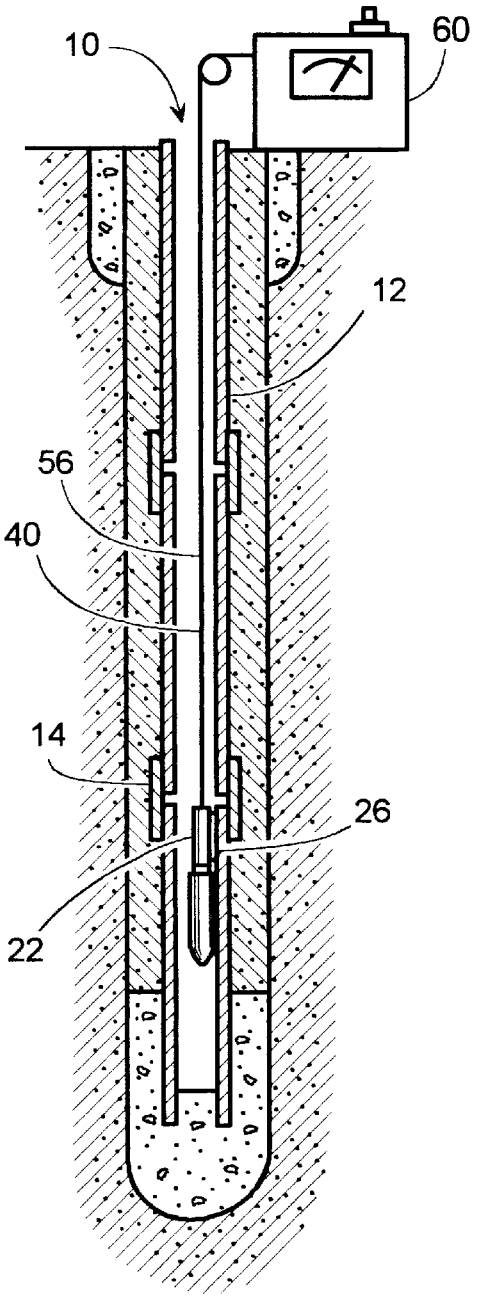
FIG. 6 is a cross-sectional view showing the lowering of a tool into a wellbore.
Figure 7:
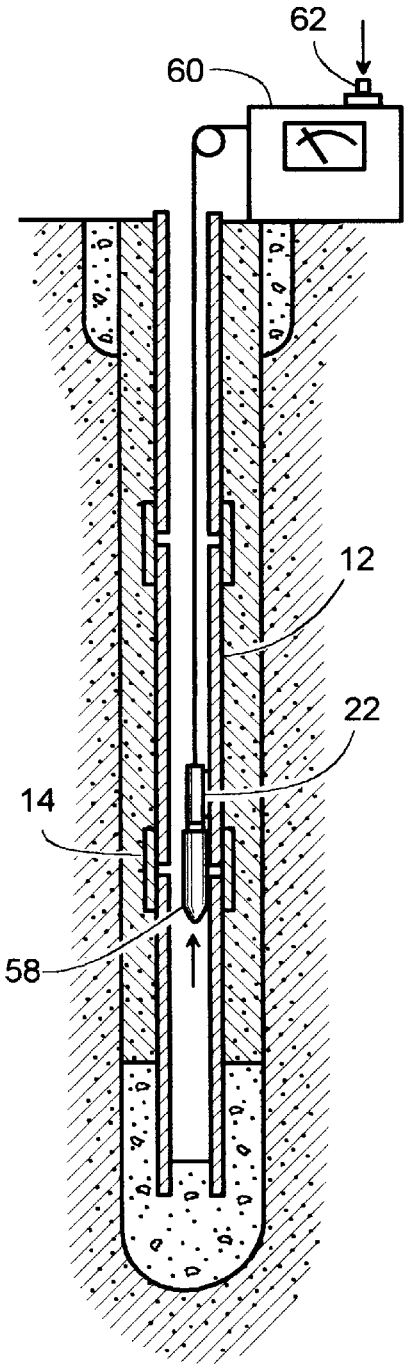
FIG. 7 is a cross-sectional view showing the repositioning of a tool within a wellbore.

FIG. 6 shows signal 56 being registered on an instrument 60 (e.g., combination DC power supply and microampmeter) as magnet 26 is being lowered past collar 14. Once casing collar 14 is located, housing 22 is raised slightly (see FIG. 7) to align linear charge 58 with collar 14. Switch 62 trips a conventional circuit (well known to those skilled in the art) to deliver a current of sufficient amplitude through inner conductor 42 for igniting cap 38' which in turn detonates charge 58 which splits collar 14.

Other items worth mentioning include a set screw 64 that in assembly allows charge 36 and 58 to face in the same forward direction 46 as magnet 26. Offsetting magnet 26 from centerline 24 tends to direct its magnetic field 30 away from pipe coupling 18. This minimizes the likelihood of mistakenly identifying an inner pipe coupling 18 as an outer casing collar 14. Details of wellbore tools are found in U.S. Pat. No. 5,720,344 which is specifically incorporated by reference herein.

Although the invention is described with respect to a preferred embodiment, modifications thereto will be apparent to those skilled in the art. Therefore, the scope of the invention is to be determined by reference to the claims which follow.

I claim:

1. A method of employing a dual-purpose magnet in servicing a wellbore, said wellbore having a plurality of casing pipes interconnected by a plurality of casing collars, said method comprising:

lowering a housing having a longitudinal centerline into said plurality of casing pipes, said housing holding a dual-purpose magnet having a center of gravity that is radially offset in a forward direction to said longitudinal centerline, said housing holding a coil that is exposed to a magnetic field of said dual-purpose magnet;

drawing said housing toward an inner wall of said plurality of casing pipes by way of a radial force provided mostly by said dual-purpose magnet, thereby providing a first purpose of said dual-purpose magnet;

lowering said dual-purpose magnet past one casing collar of said plurality of casing collars;

disturbing said magnetic field as a result of lowering said dual-purpose magnet past said one casing collar;

generating an electrical signal from said coil primarily as a consequence of said magnetic field being disturbed, thereby providing a second purpose of said dual-purpose magnet; and identifying a location of said one casing collar along said wellbore based upon said electrical signal.

2. The method of claim 1 further comprising electrically igniting a cap which in turn detonates an explosive charge, said cap and said explosive charge being housed by said housing, said explosive charge being radially offset to said longitudinal centerline in said forward direction, whereby said explosive charge faces toward said inner wall as said dual-purpose magnet draws said housing toward said inner wall.

3. The method of claim 2 wherein said explosive charge is substantially linear for splitting said one casing collar.

4. The method of claim 2 wherein said explosive charge is substantially round for perforating a hole through one of said plurality of casing pipes.

5. A method of employing a dual-purpose magnet in servicing a wellbore, said wellbore having a plurality of casing pipes interconnected by a plurality of casing collars, said method comprising:

lowering a housing having a longitudinal centerline into said plurality of casing pipes, said housing holding a dual-purpose magnet having a center of gravity that is radially offset in a forward direction to said longitudinal centerline, said housing holding a coil that is exposed to a magnetic field of said dual-purpose magnet;

drawing said housing toward an inner wall of said plurality of casing pipes by way of a radial force provided mostly by said dual-purpose magnet, thereby providing a first purpose of said dual-purpose magnet;

lowering said dual-purpose magnet past one casing collar of said plurality of casing collars;

disturbing said magnetic field as a result of lowering said dual-purpose magnet past said one casing collar;

generating an electrical signal from said coil primarily as a consequence of said magnetic field being disturbed, thereby providing a second purpose of said dual-purpose magnet;

identifying a location of said one casing collar along said wellbore based upon said electrical signal, and;

electrically igniting a cap which in turn detonates an explosive charge, said cap and said explosive charge being housed by said housing, said explosive charge being radially offset to said longitudinal centerline in said forward direction, whereby said explosive charge faces toward said inner wall as said dual-purpose magnet draws said housing toward said inner wall.

6. The method of claim 5 wherein said explosive charge is substantially linear for splitting said one casing collar.

7. The method of claim 5 wherein said explosive charge is substantially round for perforating a hole through one of said plurality of casing pipes.

8. A method of employing a dual-purpose magnet in servicing a wellbore, said wellbore having a plurality of casing pipes interconnected by a plurality of casing collars, said method comprising:

lowering a housing having a longitudinal centerline into said plurality of casing pipes, said housing holding a dual-purpose magnet having a center of gravity that is radially offset in a forward direction to said longitudinal centerline, said housing holding a coil that is exposed to a magnetic field of said dual-purpose magnet;

drawing said housing toward an inner wall of said plurality of casing pipes by way of a radial force provided mostly by said dual-purpose magnet, thereby providing a first purpose of said dual-purpose magnet;

lowering said dual-purpose magnet past one casing collar of said plurality of casing collars;

disturbing said magnetic field as a result of lowering said dual-purpose magnet past said one casing collar;

generating an electrical signal from said coil primarily as a consequence of said magnetic field being disturbed, thereby providing a second purpose of said dual-purpose magnet;

identifying a location of said one casing collar along said wellbore based upon said electrical signal;

electrically igniting a cap which in turn detonates an explosive charge that is substantially linear, said cap and said explosive charge being housed by said housing, said explosive charge being radially offset to said longitudinal centerline in said forward direction, whereby said explosive charge faces toward said inner wall as said dual-purpose magnet draws said housing toward said inner wall; and splitting said one casing collar with said explosive charge that is substantially linear.

* * * * *